US011963620B2

(12) United States Patent
Long

(10) Patent No.: US 11,963,620 B2
(45) Date of Patent: Apr. 23, 2024

(54) FLAT WIREDRAWING MATTRESS

(71) Applicant: Shouguo Long, Zhongshan (CN)

(72) Inventor: Shouguo Long, Zhongshan (CN)

( * ) Notice: Subject to any disclaimer, the term of this patent is extended or adjusted under 35 U.S.C. 154(b) by 286 days.

(21) Appl. No.: 17/287,251

(22) PCT Filed: Nov. 26, 2020

(86) PCT No.: PCT/CN2020/131645
§ 371 (c)(1),
(2) Date: Apr. 21, 2021

(87) PCT Pub. No.: WO2022/082926
PCT Pub. Date: Apr. 28, 2022

(65) Prior Publication Data

US 2022/0304477 A1 Sep. 29, 2022

(30) Foreign Application Priority Data

Oct. 19, 2020 (CN) ..... 202022332296.0

(51) Int. Cl.
*A47C 27/08* (2006.01)

(52) U.S. Cl.
CPC ..... *A47C 27/087* (2013.01)

(58) Field of Classification Search
CPC ..... A47C 27/087
USPC ..... 5/712
See application file for complete search history.

(56) References Cited

U.S. PATENT DOCUMENTS 4,541,135 A 9/1985 Karpov
7,089,618 B1 * 8/2006 Metzger ..... A47C 27/087 5/709
7,107,641 B2 9/2006 Davis
9,127,471 B1 * 9/2015 Greer ..... E04H 4/103
9,848,706 B2 * 12/2017 Wang ..... A47C 4/54
(Continued)

FOREIGN PATENT DOCUMENTS

CN 109043958 A 12/2018
CN 110101247 A 8/2019
(Continued)

OTHER PUBLICATIONS

Jul. 15, 2021 International Search Report issued in International Patent Application No. PCT/CN2020/131645.
(Continued)

*Primary Examiner* — Myles A Throop

(57) ABSTRACT

A flat wiredrawing mattress includes at least a top, bottom and a side piece enclosed between the top and bottom piece, at least a hermetic air chamber is formed between the top, bottom and side pieces, a wiredrawing structure is between the top and bottom piece, and the side piece has a tension connecting piece group for tightening and smoothing. During use, the wiredrawing structure prevents the top and bottom piece swelling and makes the mattress surface flatter, avoiding uneven situation. The elastic pulling force of the wiredrawing structure on the top and bottom piece compress the air in the air chamber. The mattress body is not deformed with stable structure and better firmness. The tension connecting piece tightens the side piece, supports and flattens it, and flattens the mattress surrounding. The overall structure of the mattress is flat, and can be kept flush with the wall during use.

7 Claims, 7 Drawing Sheets

(56) References Cited

U.S. PATENT DOCUMENTS

| | | | | |
|---|---|---|---|---|
| 11,058,226 | B2 * | 7/2021 | Hsu | A47C 27/087 |
| 2003/0024050 | A1 * | 2/2003 | Boso | A47C 27/087 5/713 |
| 2016/0353907 | A1 * | 12/2016 | Lava | A47C 27/002 |
| 2017/0340145 | A1 * | 11/2017 | McCullough | A47G 9/0292 |
| 2021/0127849 | A1 * | 5/2021 | Li | A47C 27/081 |
| 2021/0196053 | A1 * | 7/2021 | Li | A47C 27/10 |
| 2021/0259434 | A1 * | 8/2021 | Wang | A47C 27/10 |
| 2023/0320491 | A1 * | 10/2023 | Hou | A47C 27/087 5/706 |

FOREIGN PATENT DOCUMENTS

| | | | |
|---|---|---|---|
| CN | 110680113 | A | 1/2020 |
| CN | 110680114 | A | 1/2020 |
| CN | 211582347 | U | 9/2020 |

OTHER PUBLICATIONS

Jul. 15, 2021 Written Opinion of the International Searching Authority issued in International Patent Application No. PCT/CN2020/131645.

* cited by examiner

FLAT WIREDRAWING MATTRESS

FIELD OF THE INVENTION

The invention relates to a flat wiredrawing mattress.

BACKGROUND OF THE INVENTION

After the traditional inflatable mattress is inflated, the surrounding four sides will expand outward to form an arc-shaped bulge. Its structure is uneven, it cannot keep level with the wall when it is used, and its appearance is not beautiful enough.

SUMMARY OF THE INVENTION

The problem to be solved by the invention is to provide a flat wiredrawing mattress.

The purpose of the invention is achieved in this way:

A flat wiredrawing mattress, comprising at least a top piece, at least a bottom piece and at least a side piece enclosed between the peripheral edge of the top piece and the peripheral edge of the bottom piece, at least a hermetic air chamber is formed between the top piece, the bottom piece and the side piece, at least one wiredrawing structure is provided between the top piece and the bottom piece, and the side piece is provided with at least a tension connecting piece group for tightening and smoothing it.

The invention adopts the above structure, when the air chamber is inflated, the wiredrawing structure can prevent the top piece and the bottom piece from bulging and make the mattress surface have better flatness, thereby avoiding the uneven situation. Moreover, the elastic pulling force of the wiredrawing structure acting on the top piece and the bottom piece can compress the air in the air chamber, so that the mattress body will not be easily deformed during use with stable structure and better firmness. The tension connecting piece group tightens the side piece and supports and flattens it, so that the surrounding of the wiredrawing mattress is flat, and the overall structure of the wiredrawing mattress is flat and beautiful, and it can be kept flush with the wall during use.

In the flat wiredrawing mattress, the tension connecting piece group can adopt various structures, in a first structure, the tension connecting piece group comprises a first tension connecting piece, a second tension connecting piece, a third tension connecting piece and a fourth tension connecting piece, the first tension connecting piece is provided on an upper side of the side piece and both sides of the first tension connecting piece are connected with the side piece, the fourth tension connecting piece is provided on a lower side of the side piece and both sides of the fourth tension connecting piece are connected with the side piece, two sides of the second tension connecting piece are respectively connected with the first tension connecting piece and the side piece, and two sides of the third tension connecting piece are respectively connected with the fourth tension connecting piece and the side piece. The side piece is tightened and flattened by the first tension connecting piece, the second tension connecting piece, the third tension connecting piece and the fourth tension connecting piece, so that the surrounding surface of the entire mattress is flat.

In the flat wiredrawing mattress, in the first structure of the tension connecting piece group, a first inflatable space is formed between the first tension connecting piece and the side piece, a second inflatable space is formed between the fourth tension connecting piece and the side piece, the second tension connecting piece is connected to the third tension connecting piece and is welded to the middle of the side piece, a third inflatable space is formed between the second tension connecting piece and the first tension connecting piece and the side piece, a fourth inflatable space is formed between the third tension connecting piece and the fourth tension connecting piece and the side piece, the side piece is provided with at least a first air hole, at least a second air hole, at least a third air hole and at least a fourth air hole that respectively connect the air chamber with the first inflatable space, the second inflatable space, the third inflatable space and the fourth inflatable space. The air in the air chamber can enter the first inflatable space, the second inflatable space, the third inflatable space and the fourth inflatable space through the first air hole, the second air hole, the third air hole and the fourth air hole, so that the first tension connecting piece, the second tension connecting piece, the third tension connecting piece and the fourth tension connecting piece are tightened, the side piece is pulled tighter, and the surrounding surface of the entire mattress is flatter.

In the flat wiredrawing mattress, in another structure of the tension connecting piece group, the tension connecting piece group comprises a first tension piece, a second tension piece and a third tension piece, an upper side, a lower side and a middle part of the first tension piece are welded to the side piece, the second tension piece is provided on an upper part of the side piece and both sides of the second tension piece are respectively connected with the first tension piece and the side piece, the third tension piece is provided on a lower part of the side piece and both sides of the third tension piece are respectively connected with the first tension piece and the side piece. The side piece is tightened and flattened by the first tension piece, the second tension piece and the third tension piece, so that the surrounding surface of the entire mattress can also be flattened.

In the flat wiredrawing mattress, the wiredrawing structure is composed of wiredrawing threads densely arranged between the top piece and the bottom piece, so as to ensure the balance of the forces on the top piece and the bottom piece, and further ensure the flatness of the mattress surface. At the same time, the evenly distributed high-strength, high-density wiredrawing threads ensure the internal strength of the mattress.

In the flat wiredrawing mattress, the side piece is provided with at least one air nozzle for inflating and deflating the air chamber. The air chamber can be inflated and deflated through the air nozzle, thereby adjusting the saturation state of the air chamber.

The flat wiredrawing mattress, further comprises at least one sheet accessory that can improve the comfort of use, and the sheet accessory can be a soft fabric for mattress surface bonded on the top surface of the top piece.

In the flat wiredrawing mattress, the sheet accessory can also be a bed cover for completely covering the top piece, the bottom piece, the side piece and the tension connecting piece group, at least one side part of the bed cover is provided with at least a zipper for sealing.

In the flat wiredrawing mattress, the sheet accessory can also be a coverlet for covering the top piece, and the peripheral edge of the coverlet is provided with at least one rubber string for tightening the tension connecting piece group.

The flat wiredrawing mattress can be used not only for single beds, but also for multi-person beds. In another specific embodiment of a suitable double bed, at least a spacer is provided between the top piece and the bottom piece to divide the air chamber into a first air chamber and a second air chamber, and both sides of the side piece are respectively provided with at least one air nozzle to inflate and deflate the first air chamber and the second air chamber accordingly. The spacer can divide the mattress into two, and the air nozzles of both sides of the side piece are independently used for the inflation and deflation of the first air chamber and the second air chamber respectively, so as to meet the requirements of two users for different air pressure and hardness of the mattress.

DESCRIPTION OF THE DRAWINGS

The following is a further detailed description in combination with the drawings and the embodiments of the invention.

DETAILED DESCRIPTION OF THE INVENTION

Figure 1:
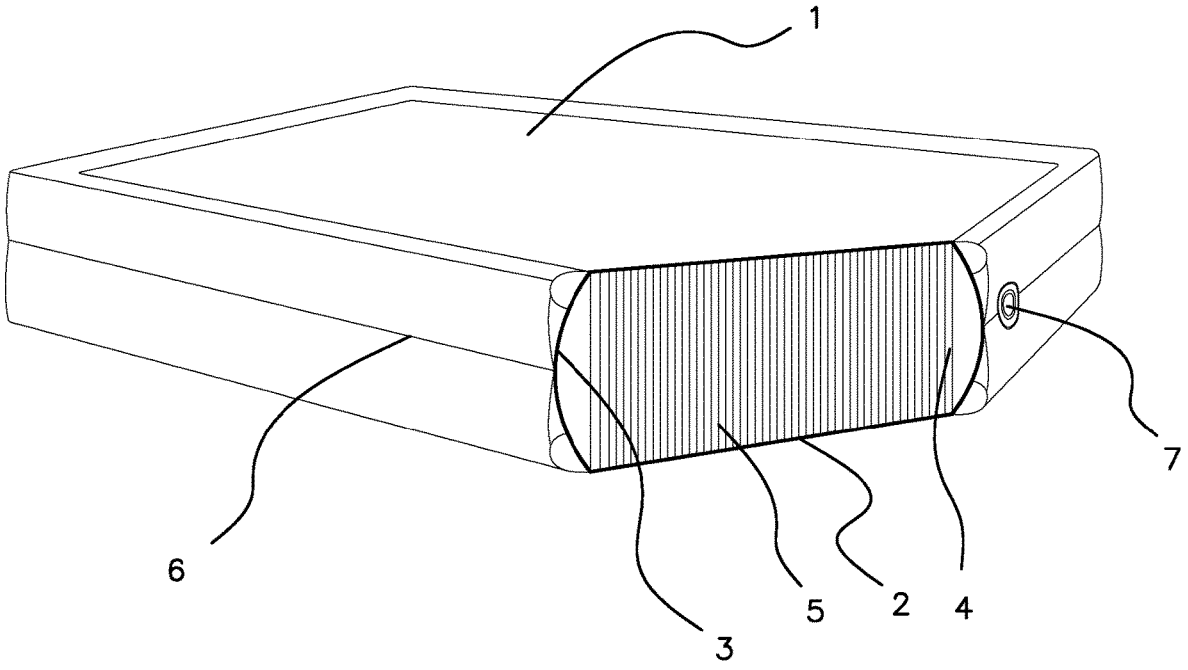
FIG. 1 is a schematic view of the invention.

A flat wiredrawing mattress, comprising at least a top piece 1, at least a bottom piece 2 and at least a side piece 3 enclosed between the peripheral edge of the top piece 1 and the peripheral edge of the bottom piece 2, at least a hermetic air chamber 4 is formed between the top piece 1, the bottom piece and the side piece 3, at least a wiredrawing structure 5 is provided between the top piece 1 and the bottom piece 2, and the side piece 3 is provided with a tension connecting piece group 6 for tightening and smoothing it.

Figure 2:
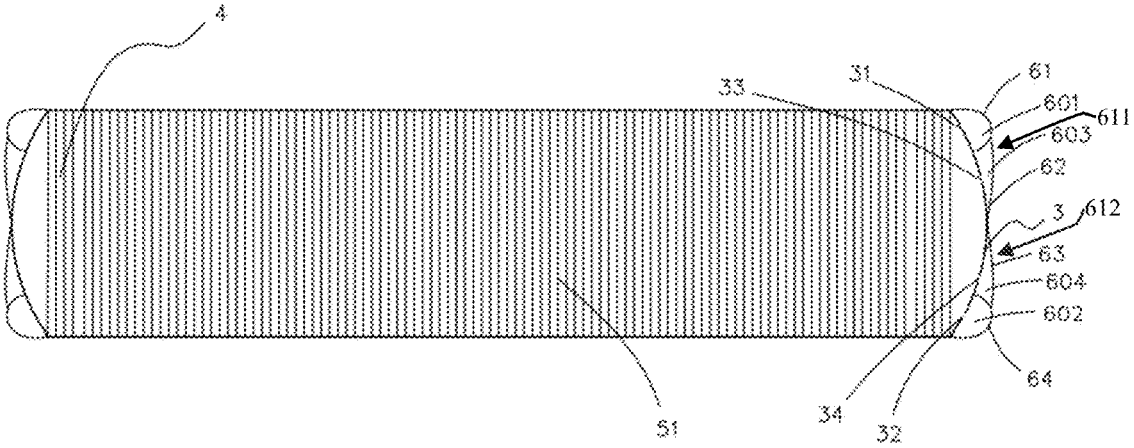
FIG. 2 is a sectional view of the invention showing the first structure of the tension connecting piece group is adopted.

As shown in FIG. 2, the tension connecting piece group 6 comprises a first tension connecting piece 61, a second tension connecting piece 62, a third tension connecting piece 63 and a fourth tension connecting piece 64, the first tension connecting piece 61 is provided on an upper side of the side piece 3 and both sides of the first tension connecting piece 61 are connected with the side piece 3, the fourth tension connecting piece 64 is provided on a lower side of the side piece 3 and both sides of the fourth tension connecting piece 64 are connected with the side piece 3, two sides of the second tension connecting piece 62 are respectively connected with the first tension connecting piece 61 and the side piece 3, and two sides of the third tension connecting piece 63 are respectively connected with the fourth tension connecting piece 64 and the side piece 3. The side piece 3 is tightened and flattened by the first tension connecting piece 61, the second tension connecting piece 62, the third tension connecting piece 63 and the fourth tension connecting piece 64, so that the surrounding surface of the entire mattress is flat.

A first inflatable space 601 is formed between the first tension connecting piece 61 and the side piece 3, a second inflatable space 602 is formed between the fourth tension connecting piece 64 and the side piece 3, the second tension connecting piece 62 is connected to the third tension connecting piece 63 and is welded to the middle of the side piece 3, a third inflatable space 603 is formed between the second tension connecting piece 62 and the first tension connecting piece 61 and the side piece 3, a first air cell 611 having a triangular cross section is defined by the second tension connecting piece 62, the first tension connecting piece 61, and the side piece 3, a fourth inflatable space 604 is formed between the third tension connecting piece 63 and the fourth tension connecting piece 64 and the side piece 3, a second air cell 612 having a triangular cross section is defined by the third tension connecting piece 63, the fourth tension connecting piece 64, and the side piece 3, the side piece 3 is provided with at least a first air hole 31, at least a second air hole 32, at least a third air hole 33 and at least a fourth air hole 34 that respectively connect the air chamber 4 with the first inflatable space 601, the second inflatable space 602, the third inflatable space 603 and the fourth inflatable space 604. The air in the air chamber 4 can enter the first inflatable space 601, the second inflatable space 602, the third inflatable space 603 and the fourth inflatable space 604 through the first air hole 31, the second air hole 32, the third air hole 33 and the fourth air hole 34, so that the first tension connecting piece 61, the second tension connecting piece 62, the third tension connecting piece 63 and the fourth tension connecting piece 64 are tightened, the side piece 3 are pulled tighter, and the surrounding surface of the entire mattress is flatter.

The wiredrawing structure 5 is composed of wiredrawing threads 51 made of slender and elastic wiredrawing cloth material densely arranged between the top piece 1 and the bottom piece 2.

In order to adjust the saturation state of the air chamber 4, the side piece 3 is provided with at least one air nozzle 7 for inflating and deflating the air chamber 4.

Figure 4:
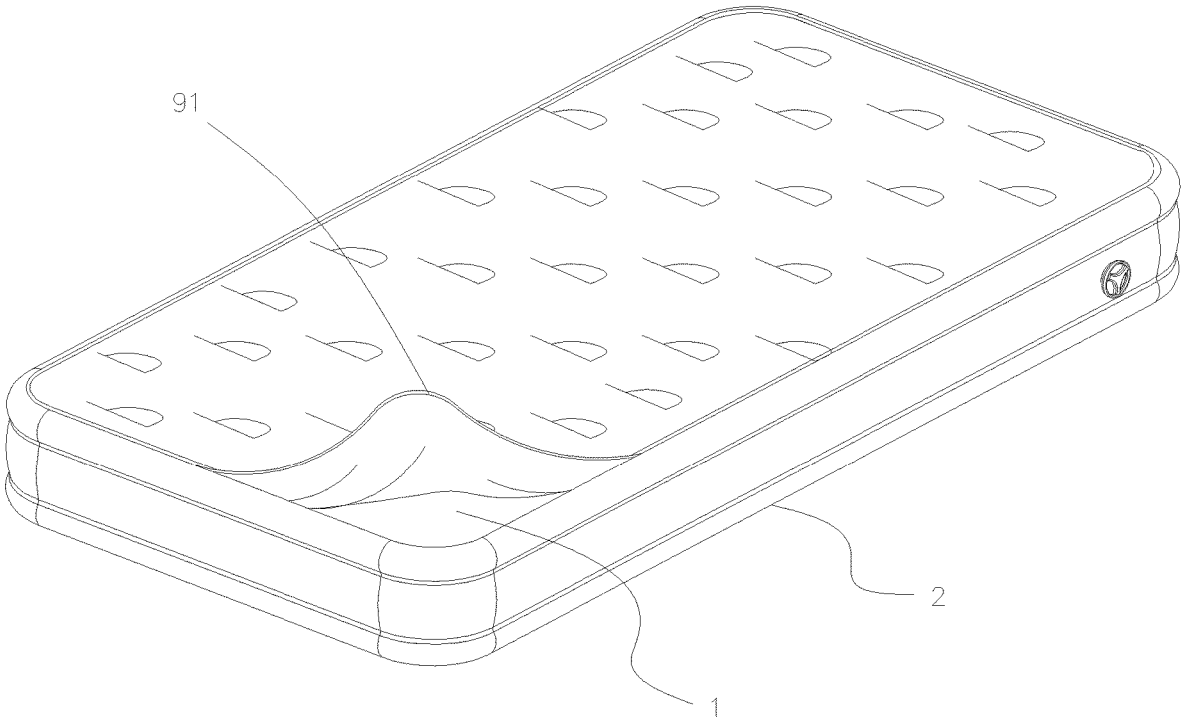
FIG. 4 is a use state view of the soft fabric for mattress surface of the invention.
Figure 5:
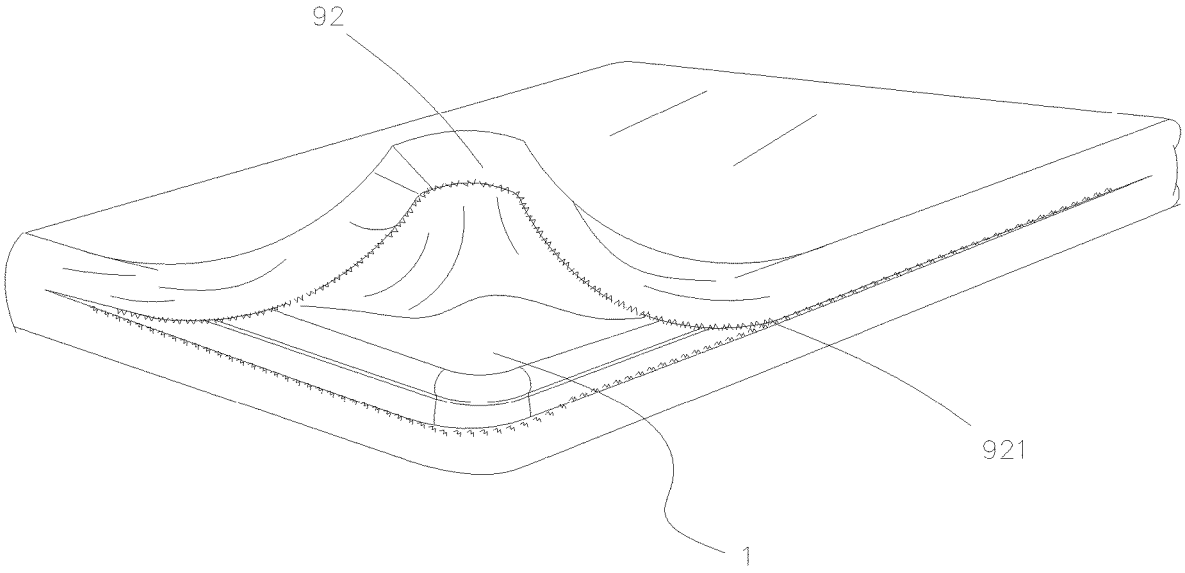
FIG. 5 is a use state view of the bed cover of the invention.
Figure 6:
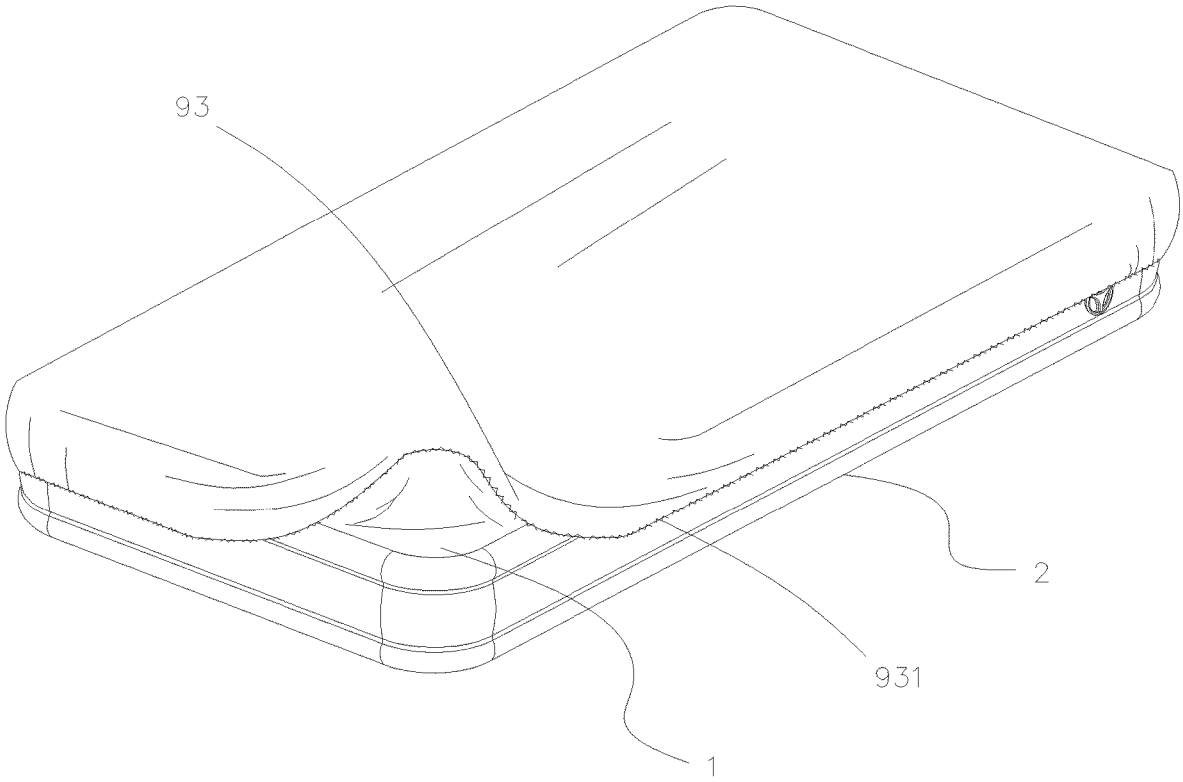
FIG. 6 is a schematic view of the coverlet of the invention.
Figure 7:
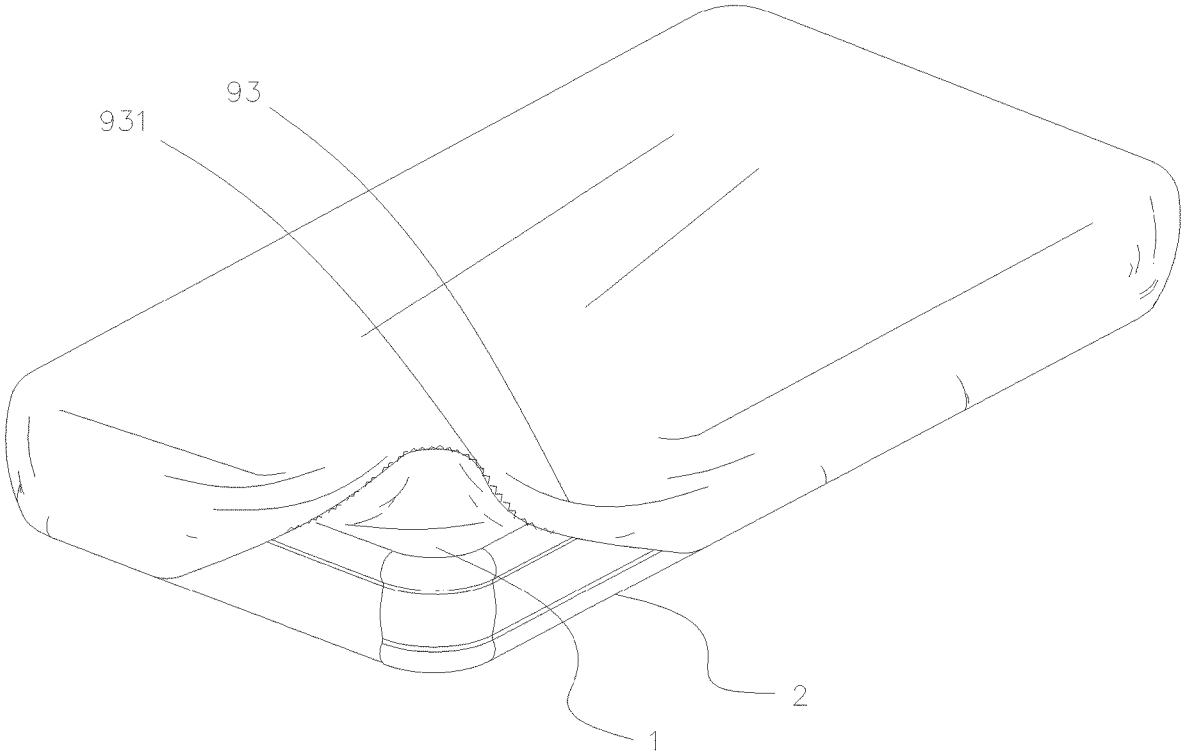
FIG. 7 is another schematic view of the coverlet of the invention.

The flat wiredrawing mattress, further comprises a sheet accessory that can improve the comfort of use, and the sheet accessory can be a soft fabric 91 for mattress surface as shown in FIG. 4 bonded on the top surface of the top piece 1, or a bed cover 92 as shown in FIG. 5 for completely covering the top piece 1, the bottom piece 2, the side piece 3 and the tension connecting piece group 6, or a coverlet 93 as shown in FIG. 6 for covering the top piece 1. Preferably, at least one side part of the bed cover 92 is provided with at least one zipper 921 as shown in FIG. 5 for sealing, the peripheral edge of the coverlet 93 is provided with at least a rubber string 931 as shown in FIG. 6 for tightening the tension connecting piece group 6. Rubber strings 931 can also be provided only at the four corners of the coverlet 93 as shown in FIG. 7. The rubber string 931 or the rubber strings 931 can also be tightened on the bottom piece 2, so that the coverlet 93 covers the top piece 1 as well as the side piece 3.

Figure 3:
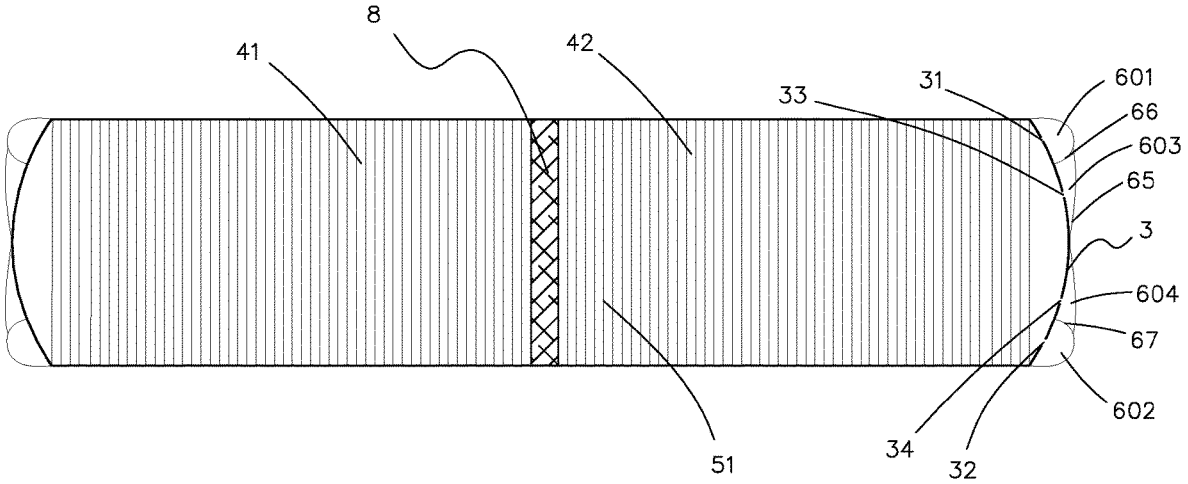
FIG. 3 is a sectional view of the invention showing another structure of the tension connecting piece group is adopted.

The flat wiredrawing mattress can be used not only for single beds, but also for multi-person beds its size is bigger than a single bed. In another embodiment of a suitable double bed, at least a spacer 8 is provided between the top piece 1 and the bottom piece 2 to divide the air chamber 4 into a first air chamber 41 and a second air chamber 42 as shown in FIG. 3, and both sides of the side piece 3 are respectively provided with at least one air nozzle 7 to inflate and deflate the first air chamber 41 and the second air chamber 42 accordingly as shown in FIG. 1. The air nozzles 7 of both sides of the side piece 3 are independently used for the inflation and deflation of the first air chamber 41 and the second air chamber 42 respectively, so as to meet the requirements of two users for different air pressure and hardness of the mattress.

The tension connecting piece group 6 can also adopt another structure, as shown in FIG. 3, in another structure, the tension connecting piece group 6 comprises a first tension piece 65, a second tension piece 66 and a third tension piece 67, an upper side, a lower side and a middle part of the first tension piece 65 are welded to the side piece 3, the second tension piece 66 is provided on an upper part of the side piece 3 and both sides of the second tension piece 66 are respectively connected with the first tension piece 65 and the side piece 3, the third tension piece 67 is provided on a lower part of the side piece 3 and both sides of the third tension piece 67 are respectively connected with the first tension piece 65 and the side piece 3. The first inflatable space 601 is formed between the first tension piece 65, the second tension piece 66 and the upper part of the side piece 3, the second inflatable space 602 is formed between the first tension piece 65, the third tension piece 67 and the lower part of the side piece 3, the third inflatable space 603 is formed between the first tension piece 65, the second tension piece 66 and the middle upper part of the side piece 3, the fourth inflatable space 604 is formed between the first tension piece 65, the third tension piece 67 and the middle lower part of the side piece 3. The side piece 3 is provided with at least a first air hole 31, at least a second air hole 32, at least a third air hole 33 and at least a fourth air hole 34 that respectively connect the air chamber 4 with the first inflatable space 601, the second inflatable space 602, the third inflatable space 603, and the fourth inflatable space 604. Through the first air hole 31, the second air hole 32, the third air hole 33 and the fourth air hole 34, the air in the air chamber 4 can enter the first inflatable space 601, the second inflatable space 602, the third inflatable space 603 and the fourth inflatable space 604, Similarly, the first tension piece 65 and the third tension piece 67 can be tightened, thereby tightening the side piece 3, and making the surrounding surface of the entire mattress flatter.

When the invention is used, an external air pump is used to inflate the air chamber 4 through the air nozzle 7, after the inflation is completed, the elastic pulling force of the wiredrawing structure 4 acting on the top piece 1 and the bottom piece 2 makes the top piece 1 and the bottom piece 2 tighten each other, and the air in the air chamber 4 is compressed. So that the mattress surface of the mattress body will not be easily deformed during use, and its structure is relatively stable, and the firmness is better, which can prevent the mattress surface from swelling and make the mattress surface have better flatness, thereby avoiding the occurrence of uneven situation. And the tension connecting piece group 6 tightens the side piece 3 and supports and flattens it. During inflation, the air in the air chamber 4 can enter the first inflatable space 601, the second inflatable space 602, the third inflatable space 603, and the fourth inflatable space 604 through the first air hole 31, the second air hole 32, the third air hole 33 and the fourth air hole 34, and make the first inflatable space 601, the second inflatable space 602, the third inflatable space 603, and the fourth inflatable space 604 reach a saturated state, so that the first tension connecting piece 61, the second tension connecting piece 62, the third tension connecting piece 63 and the fourth tension connecting piece 64 are tightened, the side piece 3 is pulled tighter, and the surrounding surface of the entire mattress is flatter. When not in use, the air chamber 4 can be deflated through the air nozzle 7. After deflation, the top piece 1 and the bottom piece 2 are automatically against together. The volume is small, and it can be easily folded and stored for convenient transportation.

What is claimed is:

1. A flat wiredrawing mattress, comprising a top piece, a bottom piece, a side piece enclosed between a peripheral edge of the top piece and a peripheral edge of the bottom piece, a hermetic air chamber formed between the top piece, the bottom piece and the side piece, and a wiredrawing structure between the top piece and the bottom piece, wherein the side piece comprises a tension connecting piece group configured to form a flattened surrounding surface of the mattress, the tension connecting piece group comprises a first tension connecting piece, a second tension connecting piece, a third tension connecting piece and a fourth tension connecting piece, the first tension connecting piece is on an upper side of the side piece, both sides of the first tension connecting piece are connected with the side piece, the fourth tension connecting piece is on a lower side of the side piece, both sides of the fourth tension connecting piece are connected with the side piece, two sides of the second tension connecting piece are respectively connected with the first tension connecting piece and the side piece, two sides of the third tension connecting piece are respectively connected with the fourth tension connecting piece and the side piece, a first inflatable space is between the first tension connecting piece and the side piece, a second inflatable space is between the fourth tension connecting piece and the side piece, the second tension connecting piece is connected to the third tension connecting piece and is welded to a middle of the side piece, a third inflatable space is between the second tension connecting piece and the first tension connecting piece and the side piece, a first air cell having a triangular cross section is defined by the second tension connecting piece, the first tension connecting piece, and the side piece, a fourth inflatable space is between the third tension connecting piece and the fourth tension connecting piece and the side piece, a second air cell having a triangular cross section is defined by the third tension connecting piece, the fourth tension connecting piece, and the side piece, the side piece comprises a first air hole, a second air hole, a third air hole and a fourth air hole that respectively connect the air chamber with the first inflatable space, the second inflatable space, the third inflatable space and the fourth inflatable space, and the wiredrawing structure is composed of wiredrawing threads of consistent length between the top piece and the bottom piece with an evenly distributed density that ensures balanced forces on the top piece and the bottom piece and results in the top piece and the bottom piece being flat.

2. The flat wiredrawing mattress according to claim 1, wherein the tension connecting piece group comprises a first tension piece, a second tension piece and a third tension piece, an upper side, a lower side and a middle part of the first tension piece are welded to the side piece, the second tension piece is on an upper part of the side piece and both sides of the second tension piece are respectively connected with the first tension piece and the side piece, the third tension piece is provided on a lower part of the side piece and both sides of the third tension piece are respectively connected with the first tension piece and the side piece.

3. The flat wiredrawing mattress according to claim 1, wherein the side piece comprises at least one air nozzle for inflating and deflating the air chamber.

4. The flat wiredrawing mattress according to claim 3, wherein a spacer is between the top piece and the bottom piece to divide the air chamber into a first air chamber and a second air chamber, both sides of the side piece are respectively provided with an air nozzle to inflate and deflate the first air chamber and the second air chamber accordingly.

5. The flat wiredrawing mattress according to claim 1, wherein a top surface of the top piece is bonded with at least one soft fabric for a mattress surface.

6. The flat wiredrawing mattress according to claim 1, further comprising a bed cover for completely covering the top piece, the bottom piece, the side piece and the tension connecting piece group, and a side part of the bed cover comprises a zipper for sealing.

7. The flat wiredrawing mattress according to claim 1, further comprising a coverlet for covering the top piece, and a peripheral edge of the coverlet comprises a rubber string for tightening the tension connecting piece group.

* * * * *